US007908667B2

(12) United States Patent
Rogers et al.

(10) Patent No.: US 7,908,667 B2
(45) **Date of Patent: *Mar. 22, 2011**

(54) MOUNTING SYSTEM FOR ACCESSORIES ON A SAFETY HELMET

(75) Inventors: David C. Rogers, Boston, MA (US); Charles H. Rogers, Halifax, MA (US); Darwin Keith-Lucas, Boston, MA (US)

(73) Assignee: Artisent, Inc., Boston, MA (US)

( * ) Notice: Subject to any disclaimer, the term of this patent is extended or adjusted under 35 U.S.C. 154(b) by 795 days.

This patent is subject to a terminal disclaimer.

(21) Appl. No.: 11/350,591

(22) Filed: Feb. 9, 2006

(65) Prior Publication Data

US 2009/0307826 A1 Dec. 17, 2009

Related U.S. Application Data

(60) Provisional application No. 60/691,307, filed on Jun. 17, 2005.

(51) Int. Cl.
*A42B 3/00* (2006.01)

(52) U.S. Cl. ..... 2/6.2; 2/410

(58) Field of Classification Search ..... 2/6.2, 422, 2/209.13, 410

See application file for complete search history.

(56) References Cited

U.S. PATENT DOCUMENTS

| | | | | |
|---|---|---|---|---|
| 4,222,123 | A | 9/1980 | Hellberg | |
| 4,224,694 | A | 9/1980 | Palmaer | |
| 4,788,724 | A | 12/1988 | Lazzeroni et al. | |
| 5,371,905 | A * | 12/1994 | Keim | 2/413 |
| 5,790,681 | A | 8/1998 | Leppalahti | |
| 5,978,973 | A | 11/1999 | Chartrand | |
| 6,009,561 | A | 1/2000 | Bullock et al. | |
| 6,009,562 | A | 1/2000 | Bullock et al. | |
| 6,283,620 | B1 * | 9/2001 | Taylor et al. | 362/474 |
| 6,472,776 | B1 * | 10/2002 | Soto et al. | 307/400 |
| 6,751,810 | B1 * | 6/2004 | Prendergast | 2/422 |
| 2005/0132461 | A1 * | 6/2005 | Koo | 2/12 |

FOREIGN PATENT DOCUMENTS

KR 20-2003-0039621 * 3/2004

* cited by examiner

*Primary Examiner* — Shaun R Hurley
*Assistant Examiner* — Andrew W Sutton
(74) *Attorney, Agent, or Firm* — Goodwin Procter LLP

(57) ABSTRACT

Embodiments of a fixture secured, securable to, or integral with the outer shell of a helmet of the type that has a bulge or protrusion on a side thereof to facilitate convenient positional adjustment, attachment and removal of multiple accessories include a fixture for securely receiving an accessory, wherein the fixture comprises a rail for slidably and adjustably receiving a plurality of accessories thereon.

23 Claims, 8 Drawing Sheets

MOUNTING SYSTEM FOR ACCESSORIES ON A SAFETY HELMET

RELATED APPLICATION

The present application claims priority to, and the benefits of, U.S. Ser. No. 60/691,307, filed Jun. 17, 2005, the entire disclosure of which is hereby incorporated by reference.

FIELD OF THE INVENTION

This invention relates to safety helmets, and in particular to attachment of accessories that may be optionally mounted onto the helmet.

BACKGROUND OF THE INVENTION

Helmets for head protection are worn in a variety of environments and for various purposes. Accessories may be added to the helmet according to the needs of the wearer and the demands of the use environment. Such accessories may, for example, provide additional protection, as in the case of a face shield, or additional capability such as night vision. The prior art includes two approaches to attachment of accessories: through-holes and clamps. U.S. Pat. Nos. 6,009,562, 6,009,561, 4,222,123, and 5,978,973, for example, describe attachment to the shell of a helmet by means of a through-hole and specialized grommets. While the through-holes provide secure attachment, they do not lend themselves to easy affixation and removal, are not adjustable in position, and may compromise the integrity of the helmet shell. Clamping devices are taught, for example, in U.S. Pat. Nos. 4,788,724 and 4,224,694. While these designs accommodate some positional adjustment and do not require through-holes in the shell, the security of the attachment is limited, and they do not provide for multiple accessories. In law-enforcement, fire-fighting, and military applications, for example, the ability to attach multiple accessories may be important. Therefore, there exists a need to facilitate convenient attachment and detachment of multiple accessories to a helmet.

SUMMARY OF THE INVENTION

The present invention provides a platform herein referred to as a "mounting rail" that accepts one or multiple optional accessories to a safety helmet at desired locations and with positional security. The mounting rail may have slides, threaded holes, or other mounting fixtures suited to securing the accessories. The mounting rail of the present invention may be configured to present a relatively low-profile protrusion from the helmet using physical surfaces that offer low risk of snagging or being caught in external devices when accessories are not in place. The invention allows for adjustment of the position of the accessories when they are attached to the mounting rail, which desirably accepts more than one optional accessory.

The mounting rail of the present invention utilizes an interface structure secured to the outer shell of the helmet, providing surfaces for mounting accessories onto the mounting rail instead of directly onto the helmet. In some embodiments, the mounting rail may be secured to the helmet shell using existing through-holes in the helmet shell and the fasteners already employed in connection with helmet-retention components such as straps or headbands. The fasteners may be, for example, rivets or nuts and bolts and may be made from plastic (for light-duty applications), stainless steel, or forge-hardened steel (for helmets providing ballistic protection).

A preferred embodiment of the mounting rail comprises a molded component conforming to the shape of the outer shell of the helmet. In some versions, the bottom edge of the rail fixture (which itself includes one or more rails) conforms to the bottom edge of the helmet, while in other versions, the entire fixture is raised on the side of the helmet, residing, for example, over (and conforming to at least a portion of) a bulge or other protrusion or discontinuity in the helmet. The rail fixture desirably spans a sufficient circumference of the helmet shell to overlap at least two existing through-holes provided for securing retention components thereto. The mounting rail may then be secured to the helmet shell by sharing fasteners with the retention components using these through-holes. A benefit of this embodiment is that the mounting rail can be added to already-manufactured helmets by providing the appropriate mounting rail with mounting holes at the dimensions of the existing through-holes in the helmet. If necessary, modified fasteners, which may be longer than the standard fasteners, can be provided to secure both the mounting rail and the existing retention components using the existing through-holes. Avoiding the need for additional through-holes to secure the mounting rail means that the safety features of the shell are not altered. It should be stressed, however, that the use of existing through-holes is by no means necessary. Other approaches such as co-molding or thermo-bonding with the shell, bonding using adhesives, or a combination of adhesives and one or more fasteners can be used to secure the mounting rail to the helmet shell (or to fabricate it integrally therewith).

As used herein, the term "rail" refers to a mounting facility with parallel boundaries, and which slidably accepts a complementary engagement member. The preferred embodiment of the mounting rail includes a recessed groove open on at least one end and preferably on both ends. Accessories having an engagement member complementary to the recessed groove may be attached to the mounting rail by sliding the engagement member into the mounting-rail groove and securing it in place. The preferred cross-sectional profile for the groove is flat on the surface toward the helmet with angular side walls; this configuration is sometimes referred to as a dove-tail recessed groove. The opening width of the groove may range from 0.25 to 1.0 inch (and is preferably 0.75 inch) with walls angled inward from 30° to 60° (and preferably at 45°). The dovetail shape retains the attaching component by means of the angled walls, but the profile may be any suitably retentive shape (such as an "L" or "T" shape) having edges that slidably retain an attaching component, allowing it to reach a desired position where it is secured into place. Means for securing the position of the mounting element are well known in the art and may include, for example, a "thumbscrew" tightener or a "tab-and-slot" engagement mechanism.

Accordingly, in a first aspect, the invention comprises a mounting facility for a safety helmet. The mounting facility comprises a rail, securable to the helmet, for slidably receiving an accessory therein. An inner surface of the rail may have a contour conforming to the helmet, or the rail may be formed integrally with the helmet. The mounting facility desirably has sloped ends. In general, the mounting facility of the present invention will comprise a recessed retaining groove, e.g., a dovetail arrangement involving a flat inner surface and a pair of angled side walls opposed to the inner surface, or an L or T shape. The retaining groove may be substantially flat in extent, or may have a constant-radius curvature.

In a second aspect, the invention comprises safety helmet including a helmet shell, a mounting facility comprising at least one rail, securable to the helmet shell, for slidably receiving an accessory engagement member therein, and at least one accessory engagement member positionable within the at least one rail and securable thereto. In addition to any one or more of the features described above, the mounting facility may have a plurality of apertures aligning with existing through-holes in the helmet shell for facilitating affixation thereto. The mounting facility may further comprise at least one threaded hole for threadably accepting an accessory; means for accepting an element conforming to the rear of the helmet shell; and/or means for accepting a hinged connecting element on the front of the helmet.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

Figure 1A:
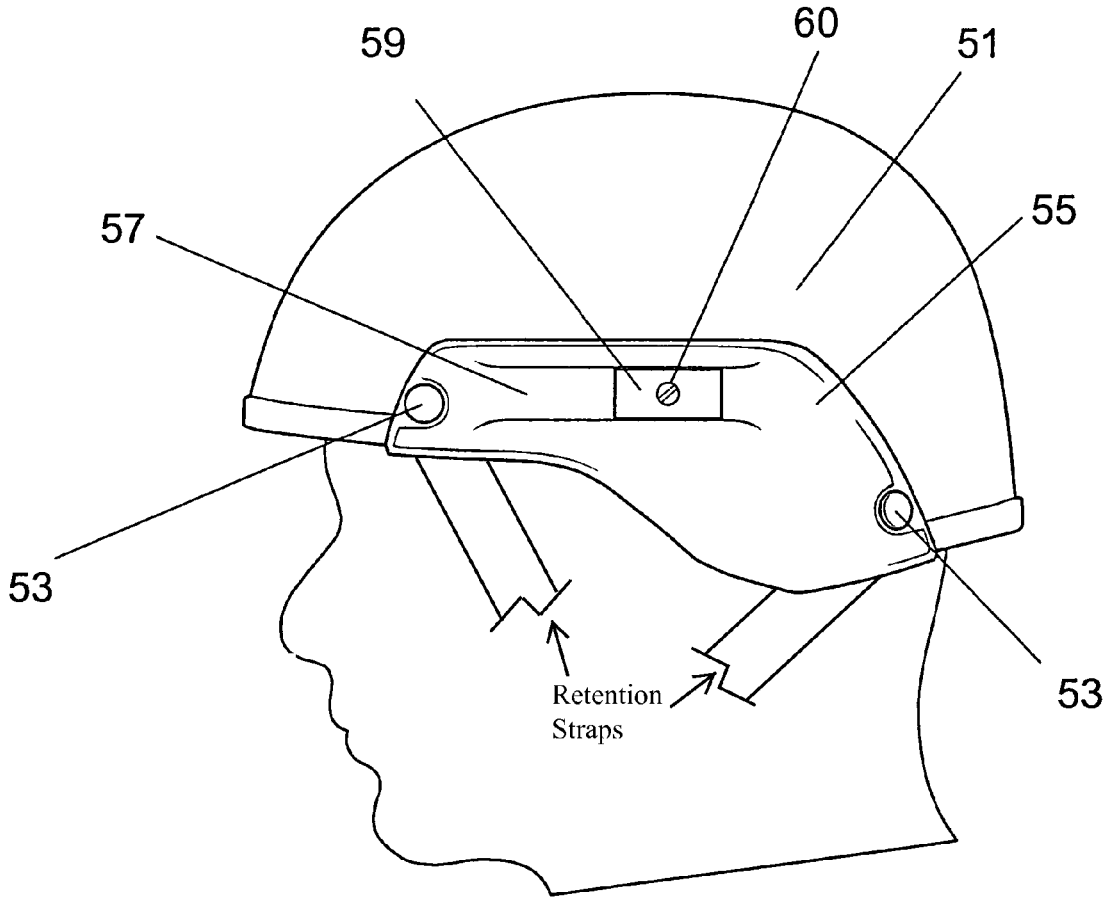
FIG. 1*a* shows the left side of a helmet having an embodiment of the mounting rail of the present invention.

With reference to FIG. 1*a*, a helmet shell 51 is shown from the left side of the user's head (the right side having symmetrical features). A mounting rail 55 in accordance with the invention is included within a fixture preferably fabricated from nylon, polypropylene, or other synthetic plastic using injection molding processes, the bottom edge of which conforms to the bottom edge of the helmet shell 51. The fixture is secured to the exterior of helmet shell 51 by means of fasteners 53 in the front and back. In another embodiment, illustrated in FIG. 1*b*, mounting rail 55 is included within a fixture having a bottom edge that conforms to a convex extension 56 of helmet shell 51.

Figure 1B:
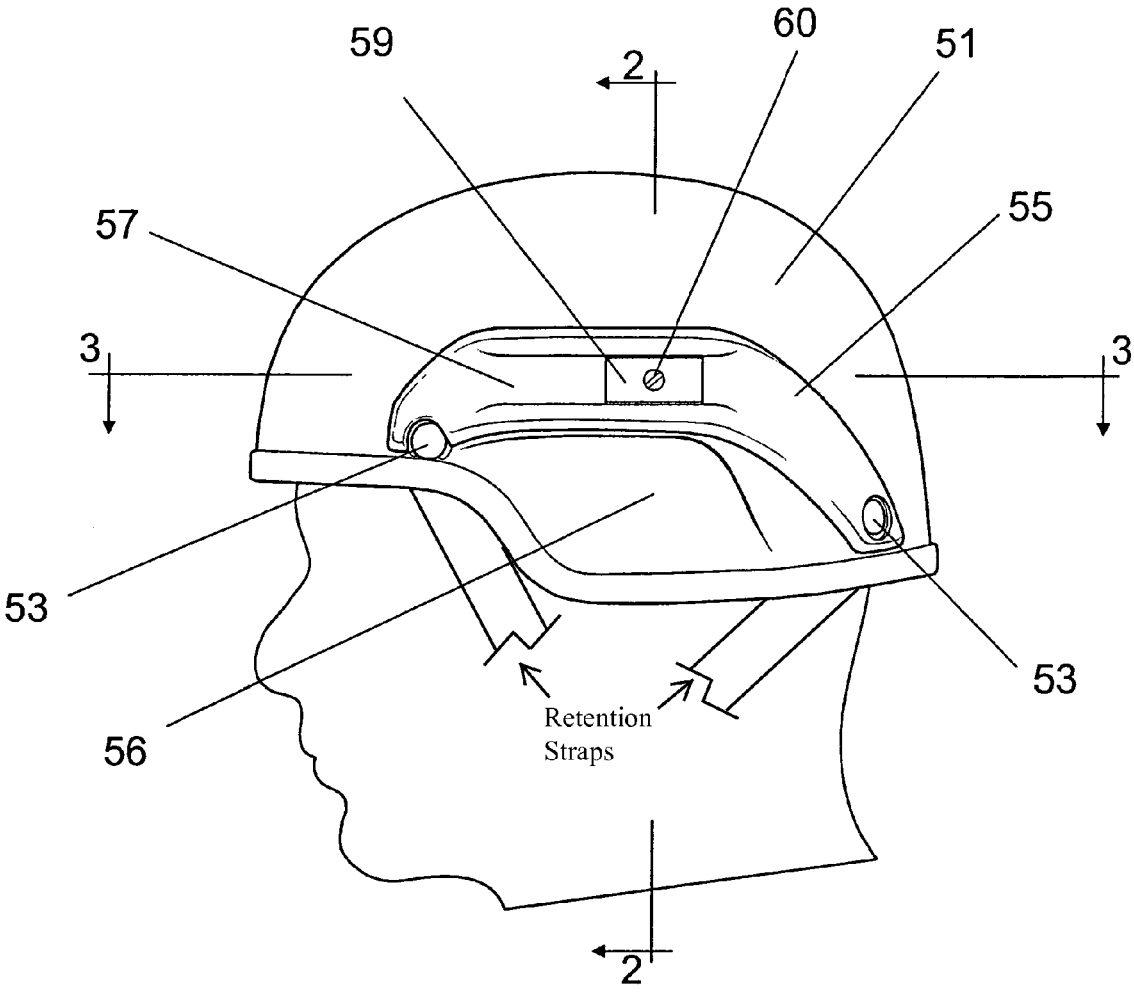
FIG. 1*b* shows the left side of a helmet having an alternate embodiment of the mounting rail of the present invention.

A recessed groove 57 in the mounting rail 55 slidably accepts a complementary engagement member 59 of a potential accessory, which may be secured by tightening a securing member 60 (e.g., a standard screw, as illustrated, or a thumbscrew, tab-and-slot system, or other suitable engagement mechanism). The engagement member 59 shown in FIGS. 1*a* and 1*b* is illustrative only; in practice, it would carry a functional accessory. Virtually any accessory suitable for mounting to the helmet 51 can be designed to have an engagement member complementary to the recessed groove 57.

Figure 2:
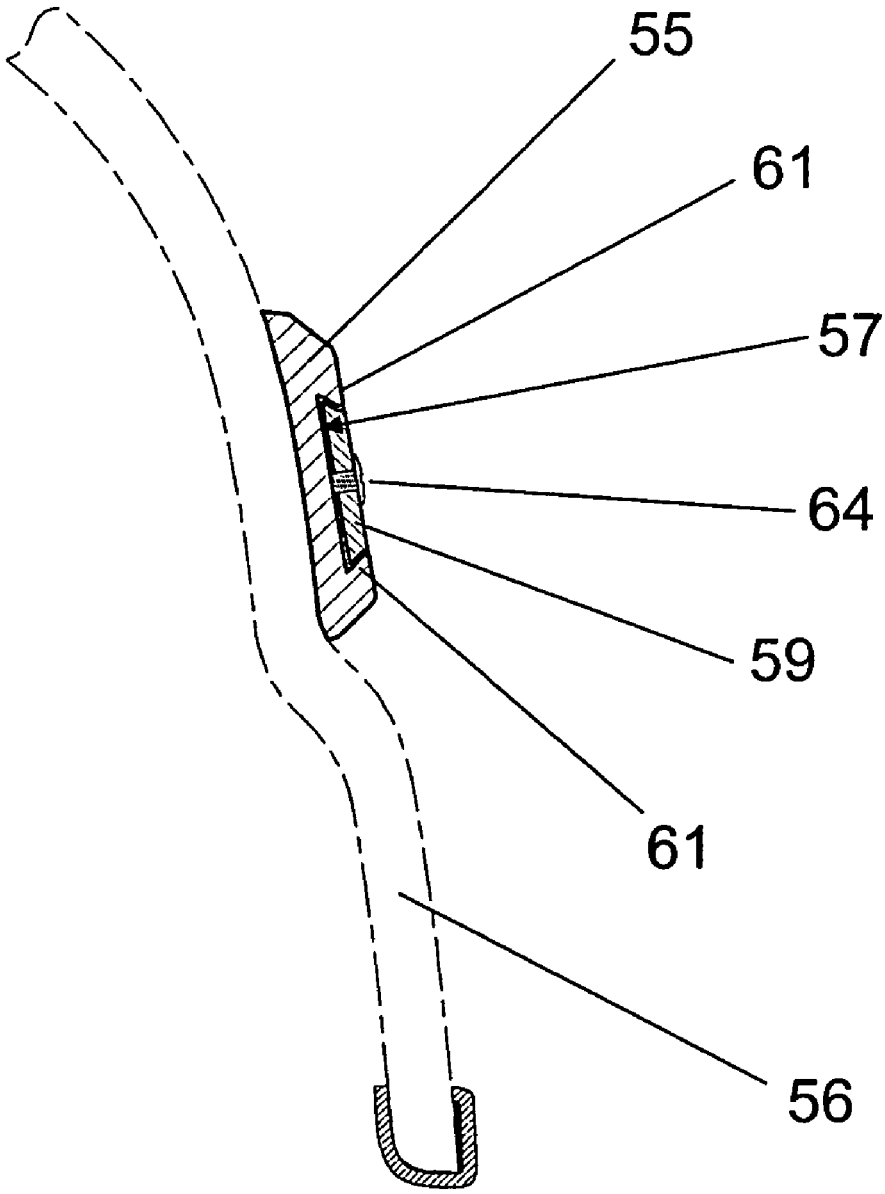
FIG. 2 is a cross-section of the mounting rail shown in FIG. 1*b* taken along the section 2-2.

In FIG. 2 the mounting rail 55 is shown in cross-section, mounted on helmet shell 51. In the illustrated embodiment, the cross-sectional profile of the recessed groove 57 is a dove-tail configuration complementary in cross-section to that of an attaching component 59. The dovetail shape retains the attaching component 59 by means of the angled edges 61, but allows it to slide within the recessed groove 57 to reach a desired position where it is further secured by a tightening screw 64. The ends of the mounting rail 55 desirably slope toward the surface of the helmet shell 51.

Figure 3A:
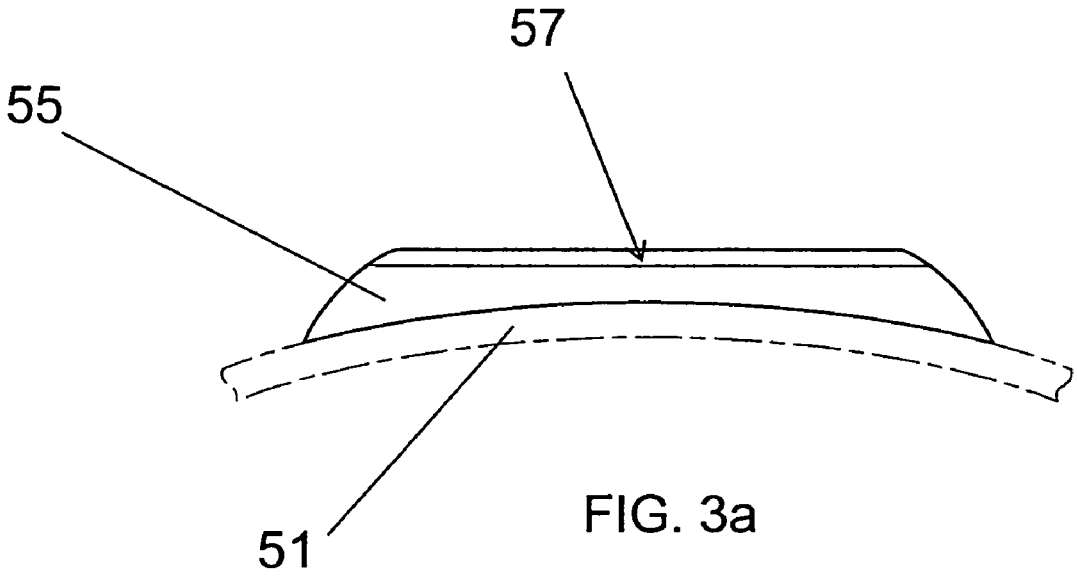
FIG. 3*a* is a cross-section of the mounting rail shown in FIG. 1*b* taken along the section 3-3.

As shown in FIG. 3*a*, the mounting rail 55 provides a geometrical interface between the curving surface of the helmet shell 51 and a straight groove 57. A straight groove 57 is beneficial because it allows attaching component 59 to be formed with simple flat surfaces while still allowing adjustment of the position of the accessory along the length of the groove 57.

Figure 3B:
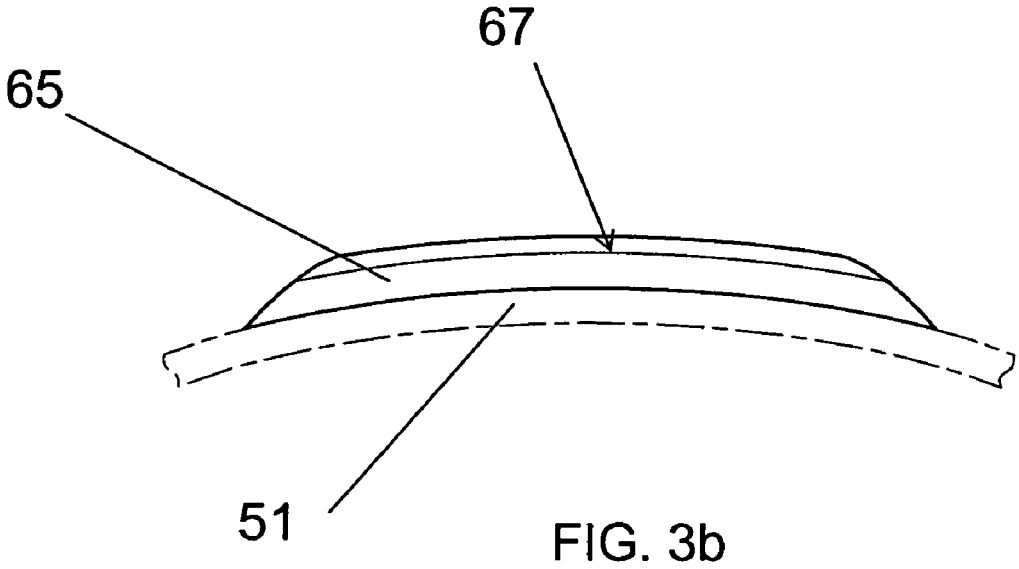
FIG. 3*b* is a cross-section similar to FIG. 3*a* showing an alternative form of the mounting rail of FIG. 1*b;*

On the other hand, as shown in FIG. 3*b*, another embodiment of the mounting rail utilizes a non-straight recessed groove 67. The inner surface of the mounting rail 65 has a contour that conforms to the helmet shell 51, and the recessed groove 67 also approximates the curved surface of the helmet shell 51 but with a constant radius. The curved groove 67 has the benefit of reducing the protrusion at the ends of the mounting rail 55 shown in FIG. 3*a*. If the recessed groove 67 has a constant radius, the attaching component 59 can have a matching curved shape and still freely slide within the groove 67. The mounting rail 65 provides an interface between differently sized helmets having different amounts of curvature and a groove 67 with a common constant radius (independent of the size and curvature of the helmet). For accessories that do not require the flat surface as shown in FIG. 3*a*, and thus the lower profile of mounting rail 65 shown in FIG. 3*b*, a curved mounting rail may be preferred.

Figure 4A:
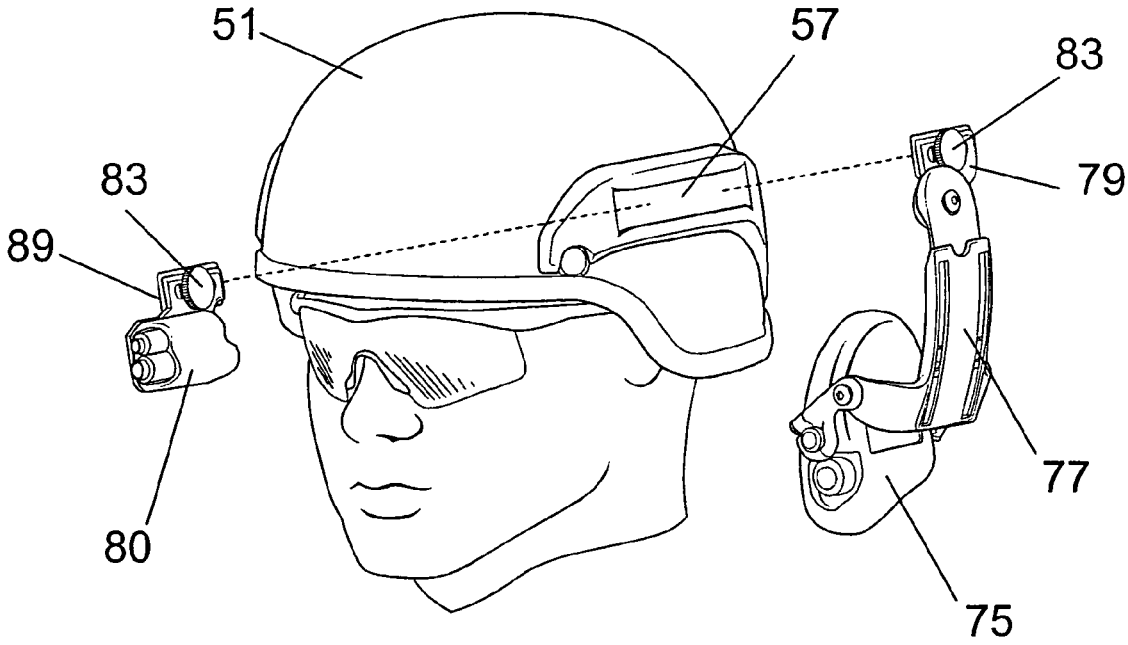
FIG. 4*a* shows the mounting rail of FIG. 1*b* with two accessories positioned to be attached.
Figure 4B:
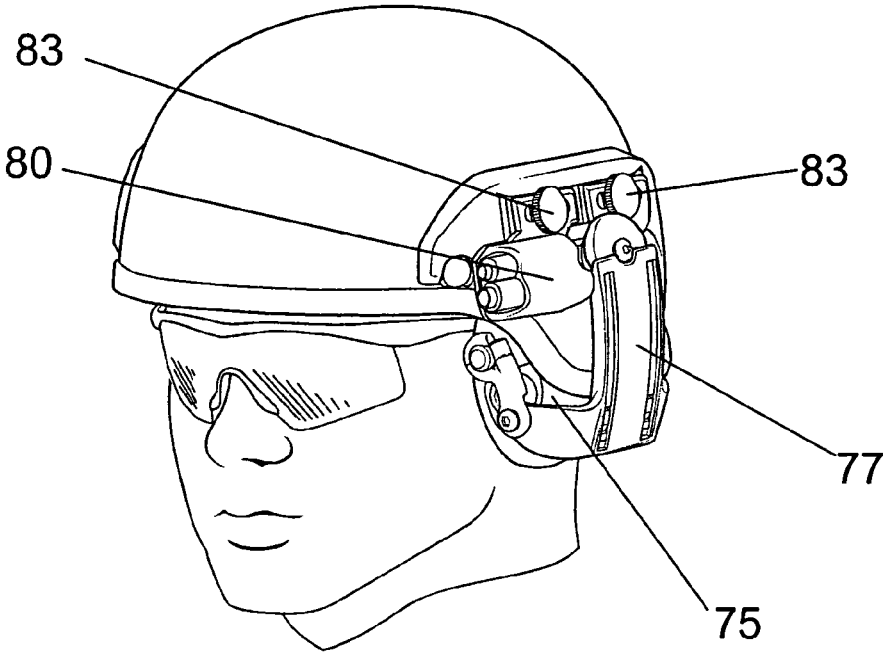
FIG. 4*b* shows the mounting rail of FIG. 4*a* with the two accessories mounted in place.

FIG. 4*a* shows the mounting rail of FIG. 1 mounted on helmet shell 51 with two accessories 75 and 80 positioned to be attached. As illustrated, accessory 75 is an earphone; a similar earphone can be mounted on the right side of the helmet in a symmetrical mounting rail (not shown). The earphone 75 is attached by a connecting member 77 to the engagement member 79, which can itself be positioned along recessed groove 57 by sliding engagement member 79 therealong and securing it with the thumbscrew 83. Accessory 80 is an illuminator that can be similarly attached by sliding the engagement member 89 within recessed groove 57 and securing it with thumbscrew 83. FIG. 4*b* shows the mounting rail of FIG. 4*a* with the two accessories 75, 80 mounted in place.

Figure 5:
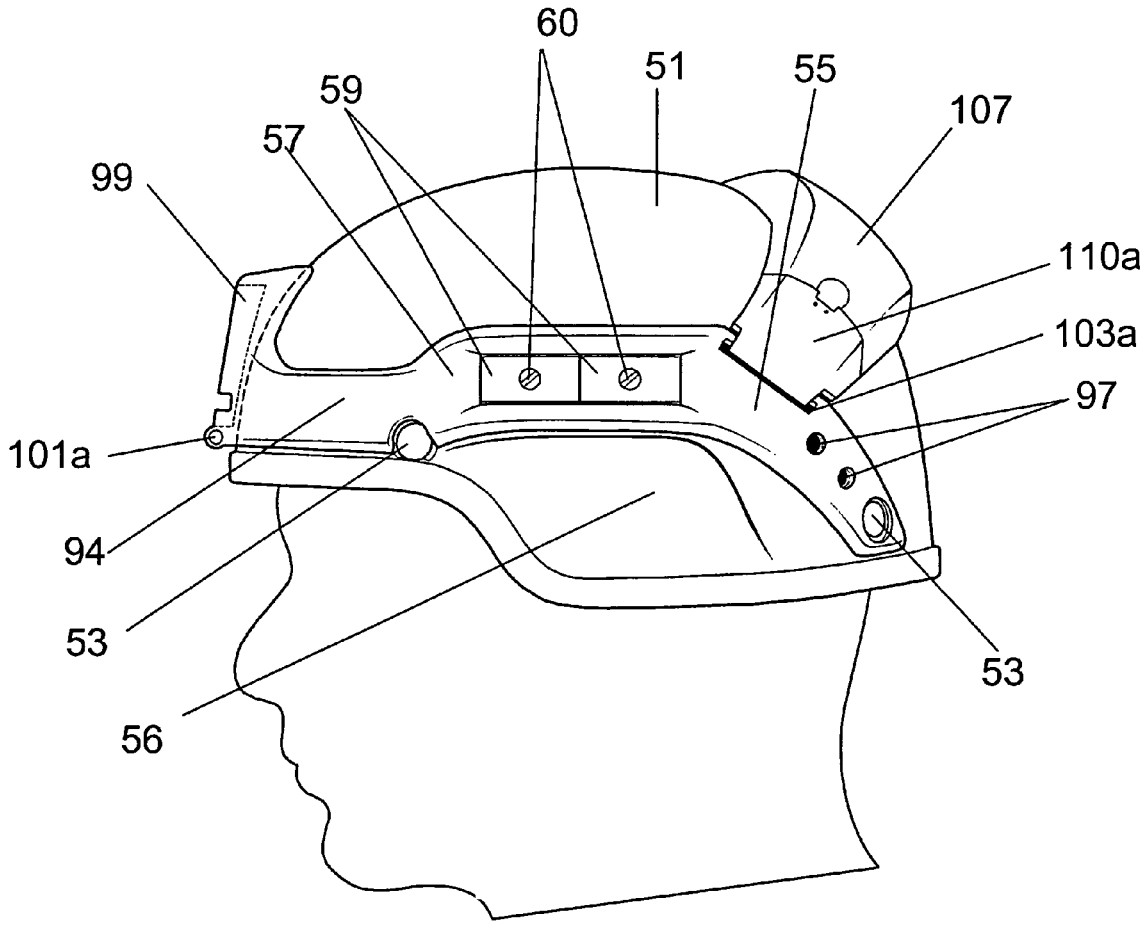
FIG. 5 shows another embodiment of the present invention having additional means of attaching accessories to a first mounting rail.

FIG. 5 shows another embodiment of the present invention mounted to a helmet shell 51. In this embodiment the mounting rail 55 on the left side of the helmet (shown) is extended forward by a front connecting element 94, which joins with the mounting rail 55 on the right side of the helmet (not shown). The entire mounting rail thus encircles three-quarters of the helmet shell 51 and is secured by means of five fasteners 53, two on each side and one in the front, which desirably penetrate the shell using the through-holes shared with retention components (not shown). This embodiment may comprise additional attaching features, it being understood that any particular version may have some, but not necessarily all of the attaching features illustrated. In addition to the recessed groove 57 already described, this embodiment has one or more threaded holes 97, which serve as mounting points for an accessory that can be threadably mounted therein. An attachment surface 99 on the front connecting element 94 accepts accessories such as PVS-14 night vision goggles to the front of the helmet. A hole 101*a* on the left side of the front connecting element 94 can be used in conjunction with a similar hole 101*b* on the right side to provide a hinged mounting point in the front for an additional accessory (see FIG. 6). Finally, a slot 103 allows a rear connecting element 107 to be attached as further described in connection with FIG. 7.

Figure 6:
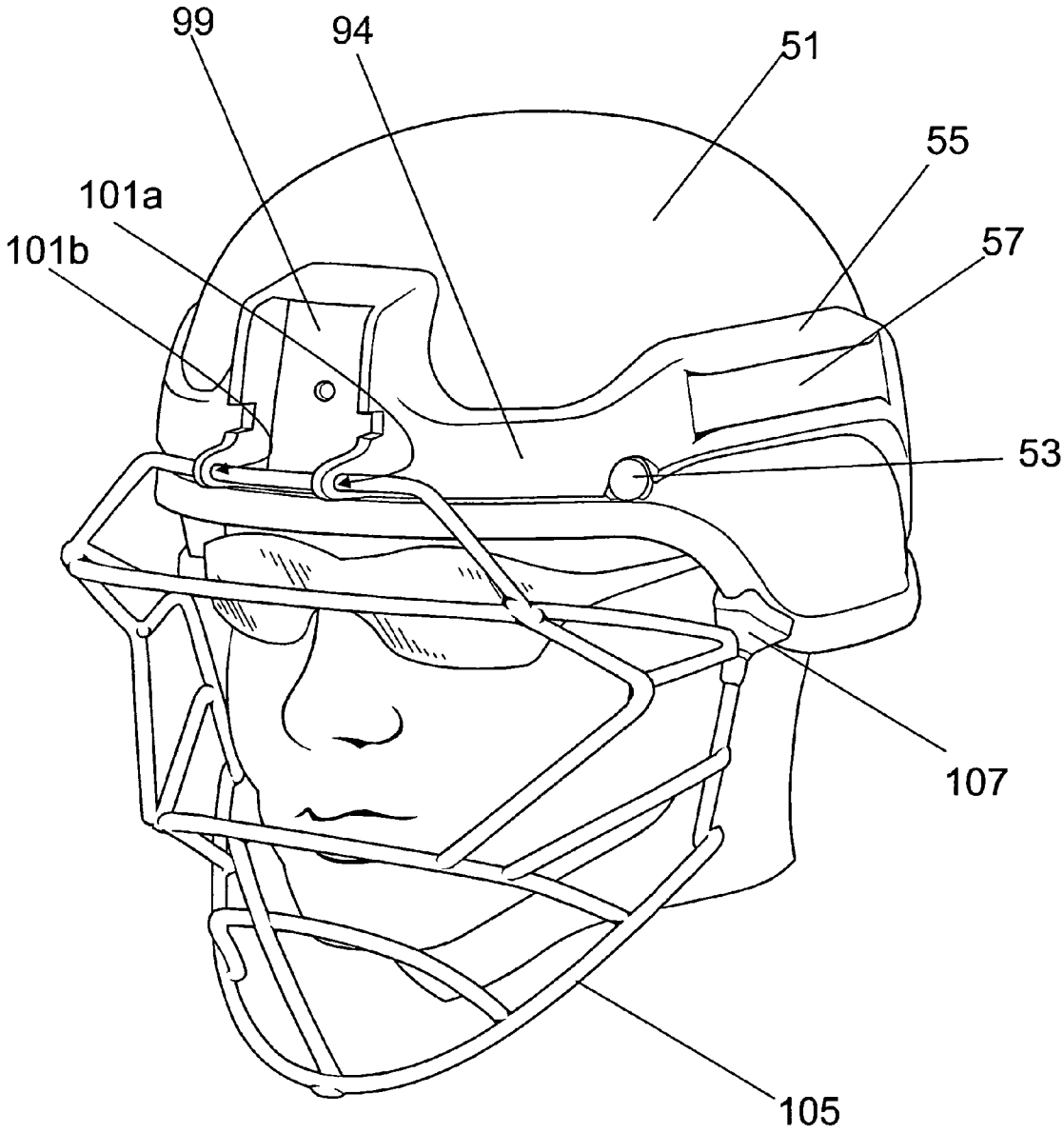
FIG. 6 shows a perspective view of the mounting rail of FIG. 5 with an accessory mounted to the front.

FIG. 6 shows a face-protection accessory 105 hingeably affixed to the mounting rail of the present invention using holes 101*a* and 101*b*. The face-protection accessory 105 may be further supported by a bumper 107 that braces against the helmet shell 51. Mounting holes 101*a*, 100*b* provide a secure, hinged attachment to the helmet, allowing the face-protection accessory 105 to be hinged upward and out of the way when not needed.

Figure 7:
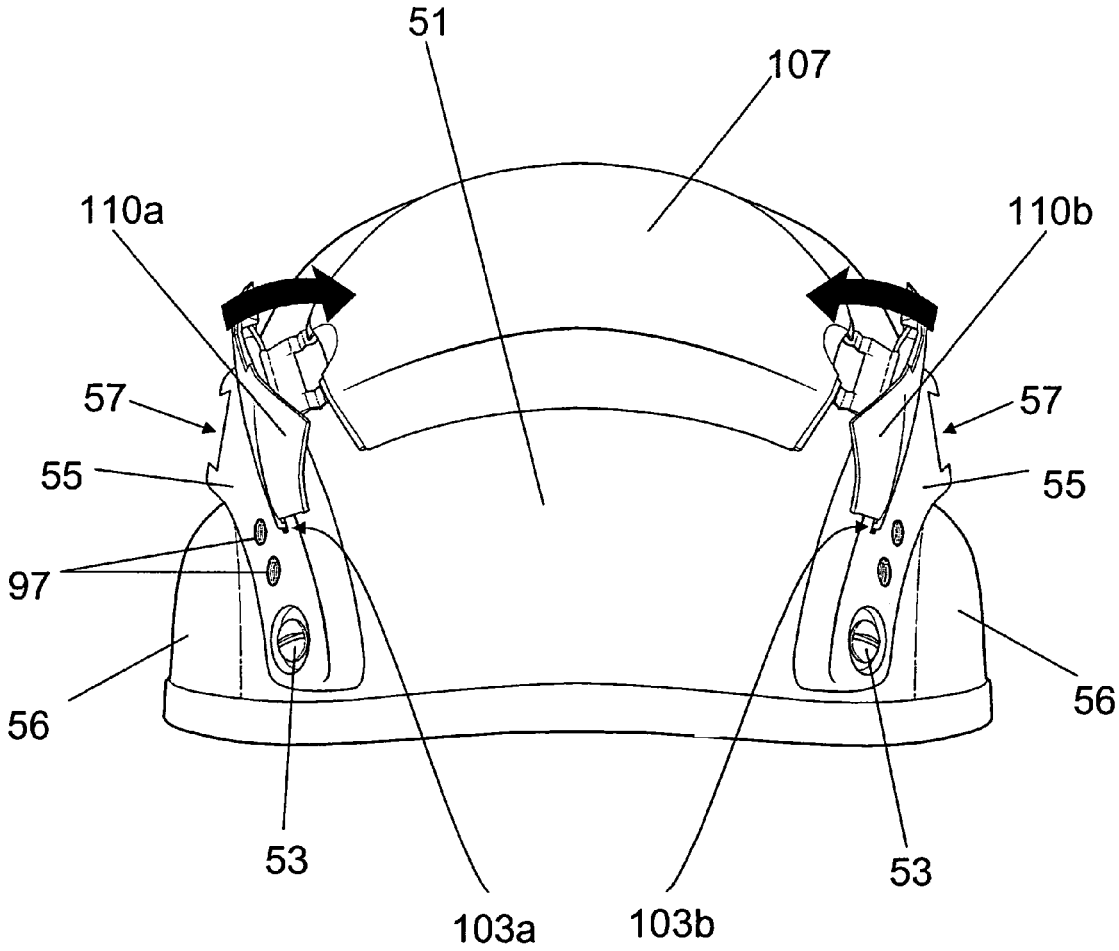
FIG. 7 is a view from the back of the helmet of FIG. 5 showing an additional element for containing and/or supporting accessories.

With reference to FIGS. 5 and 7, a rear connecting element 107 is designed to mate with slot 103*a* in mounting rail 55 on the left side and to extend around the back of the helmet shell 51 to a similar slot 103*b* on the mounting rail on the right side of the helmet. The rear connecting element 107 is desirably slightly compliant and conformal with the outer shell 51 such that when a tension is established between the two slots 103*a* and 103*b*, the rear connecting element 107 comes into close contact with the shell 51. This rear connecting element 107, which creates a bridge under tension between left-side and right-side mounting rails, allows the rails to better resist dislodgement by horizontal or rotational forces. The tension may be established by a pair of over-the-center latches 110*a*, 110*b*, which have ends adapted to fit into slots 103*a*, 103*b*, respectively, and to move hingeably downward (as indicated by the arrows) so as to snap against connecting element 107. Alternatively, tension can be provided by other suitable means known in the art such as tightening screws that pull two parts of the rear connecting element 107 together to contract its length. Accessories may be attached externally to the rear connecting element 107 using any of the attaching features as described above in connection with FIG. 5. Alternatively, rear connecting element 107 can provide a protected space for smaller accessories, such as electronic components, which can be stored within the space within the rear connecting element 107 or between it and the outer shell 51.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

The invention claimed is:

1. For use with a safety helmet of the type that has a bulge or protrusion on a side thereof and at least two existing through-holes for securing to the helmet at least one helmet-retention strap, a mounting facility comprising a fixture for securely receiving an accessory and configured for attachment to the helmet above the bulge when worn, wherein (i) the fixture comprises a rail for slidably and adjustably receiving a plurality of accessories thereon, and (ii) the fixture has a plurality of apertures aligning with at least two of the existing through-holes in the helmet shell for facilitating common affixation of the fixture and at least one helmet-retention strap thereto.

2. The mounting facility of claim 1 wherein the rail comprises a recessed retaining groove.

3. The mounting facility of claim 2 wherein the retaining groove comprises a flat inner surface and a pair of angled side walls opposed to the inner surface.

4. The mounting facility of claim 2 wherein the retaining groove has an L or T shape.

5. The mounting facility of claim 2 wherein the retaining groove has a constant-radius curvature.

6. The mounting facility of claim 1 wherein the fixture further comprises at least one threaded hole for threadably accepting an accessory.

7. The mounting facility of claim 1 further comprising means for accepting a hinged connecting element on the front of the helmet.

8. An accessory kit for a safety helmet of the type that has a bulge or protrusion on the side of the helmet and at least two existing through-holes for securing to the helmet at least one helmet-retention strap, the kit comprising:

a. at least one fixture configured for attachment to the helmet above the bulge when worn, the fixture having (i) a plurality of apertures aligning with existing through-holes in the helmet shell for facilitating common affixation of the fixture and at least one helmet-retention strap thereto and (ii) a rail for slidably and adjustably receiving a plurality of accessory engagement members;

b. fasteners for securing the at least one fixture to the helmet; and c. at least one accessory engagement member positionable within the rail and securable thereto.

9. The accessory kit of claim 8 wherein the rail comprises a recessed retaining groove.

10. The accessory kit of claim 9 wherein the retaining groove comprises a flat inner surface and a pair of angled side walls opposed to the inner surface.

11. The accessory kit of claim 9 wherein the retaining groove has an L or T shape.

12. The accessory kit of claim 9 wherein the retaining groove has a constant-radius curvature.

13. The accessory kit of claim 8 wherein the fixture further comprises at least one threaded hole for threadably accepting an accessory.

14. The accessory kit of claim 8 further comprising means for accepting a hinged connecting element on the front of the helmet.

15. A safety helmet of the type that has a bulge or protrusion on a side thereof, the helmet comprising at least two existing through-holes for securing to the helmet at least one helmet-retention strap and a fixture, located above the bulge when worn, for securely receiving an accessory, wherein (i) the fixture comprises a rail for slidably and adjustably receiving a plurality of accessories, and (ii) the fixture has a plurality of apertures aligning with at least two of the existing through-holes in the helmet for facilitating common affixation of the fixture and at least one helmet-retention strap thereto.

16. The helmet of claim 15 wherein the rail comprises a recessed retaining groove.

17. The helmet of claim 16 wherein the retaining groove comprises a flat inner surface and a pair of angled side walls opposed to the inner surface.

18. The helmet of claim 16 wherein the retaining groove has an L or T shape.

19. The helmet of claim 16 wherein the retaining groove has a constant-radius curvature.

20. The helmet of claim 15 wherein the fixture further comprises at least one threaded hole for threadably accepting an accessory.

21. The mounting facility of claim 1 further comprising means for accepting a hinged connecting element on the front of the helmet.

22. The mounting facility of claim 1, further comprising at least one fastener extending through at least one of the plurality of apertures and one of the through-holes to attach both the fixture and at least one helmet-retention strap to the safety helmet.

23. The safety helmet of claim 15, further comprising at least one fastener extending through at least one of the plurality of apertures and at least one of the through-holes to attach both the fixture and at least one helmet-retention strap to the safety helmet.

* * * * *